US007079784B2

(12) United States Patent
Kim et al.

(10) Patent No.: US 7,079,784 B2
(45) Date of Patent: Jul. 18, 2006

(54) WET TYPE ELECTROPHOTOGRAPHIC IMAGE FORMING APPARATUS AND METHOD FOR CONTROLLING OXIDATION CATALYST DEVICE THEREOF

(75) Inventors: Hyou-jin Kim, Seoul (KR); Jeong-hun Pang, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 101 days.

(21) Appl. No.: 10/944,785

(22) Filed: Sep. 21, 2004

(65) Prior Publication Data

US 2005/0152712 A1 Jul. 14, 2005

(30) Foreign Application Priority Data

Jan. 8, 2004 (KR) ..... 10-2004-0001146

(51) Int. Cl.
*G03G 21/20* (2006.01)

(52) U.S. Cl. ..... 399/93

(58) Field of Classification Search ..... 399/91–93, 399/82

See application file for complete search history.

(56) References Cited

U.S. PATENT DOCUMENTS 5,878,305 A 3/1999 Suzumura et al. ..... 399/97
6,041,201 A * 3/2000 Kim ..... 399/93
6,996,352 B1 * 2/2006 Choi et al. ..... 399/93
2004/0146314 A1 * 7/2004 Yon et al. ..... 399/93

FOREIGN PATENT DOCUMENTS

KR 1999-074129 10/1999
KR 2000-056903 9/2000
KR 2001-100843 11/2001

* cited by examiner

*Primary Examiner*—Arthur T. Grimley
*Assistant Examiner*—Ryan Gleitz
(74) *Attorney, Agent, or Firm*—Roylance, Abrams, Berdo & Goodman, LLP.

(57) ABSTRACT

A wet type electrophotographic image forming apparatus includes a photosensitive medium, a light exposure device, a developing device, a transfer device, a fuser device, an oxidation catalyst device, a temperature sensor, a power supply device and a control device. The oxidation catalyst device includes an oxidation catalyst carrying body and a heater, and removes vapor of developer solution from the fuser device by utilizing oxidation decomposition. The control device receives data about the temperature detected from the temperature sensor, and variably controls the temperature of the oxidation catalyst device in accordance operational modes such as warm-up mode, standby mode and print mode. Considering the fact that the oxidation catalyst device has higher efficiency at optimum activation temperature, appropriate temperature control can guarantee increased oxidation efficiency of the oxidation catalyst device.

19 Claims, 10 Drawing Sheets

WET TYPE ELECTROPHOTOGRAPHIC IMAGE FORMING APPARATUS AND METHOD FOR CONTROLLING OXIDATION CATALYST DEVICE THEREOF

CROSS-REFERENCE TO RELATED APPLICATIONS

This application claims the benefit under 35 U.S.C. § 119(a) of Korean Patent Application No. 2004-01146 filed Jan. 8, 2004, in the Korean Intellectual Property Office, the entire disclosure of which is incorporated herein by reference.

BACKGROUND OF THE INVENTION

1. Field of the Invention

The present invention relates to a wet type electrophotographic image forming apparatus. More particularly, the present invention relates to a wet type electrophotographic image forming apparatus having an oxidation catalyst device for removing developer vapor from the fuser through oxidation, and a method for controlling the oxidation catalyst device.

2. Description of the Related Art

A general example of wet type electrophotographic image forming apparatus scans a laser beam onto a photosensitive medium to form an electrostatic latent image thereon. A developing solution attaches to the photosensitive medium to visualize the latent image. The visualized image is transported onto a suitable recording medium. The wet type electrophotographic image forming apparatus provides an advantage over a dry-type electrophotographic image forming device utilizing powder-type developer, particularly in terms of providing clearer printouts. The wet type electrophotographic image forming apparatus is also suitable for producing high quality color images.

FIG. 1 schematically shows the structure of a conventional wet type electrophotograhic image forming apparatus 100, which comprises an image forming apparatus body 110, photosensitive drums 121, 122, 123, 124, charging devices 131, 132, 133, 134, light exposure devices 141, 142, 143, 144, developing devices 151, 152, 153, 154, a transfer belt 160, first transfer rollers 171, 172, 173, 174, a second transfer roller 180 and a fuser 190.

The developing devices 151, 152, 153, 154 each have different colors of developer therein, and supplies respective color developers to the photosensitive drums 121, 122, 123, 124. Developer is usually a mixture of ink to develop the image, and a carrier usually in liquid state such as Norpar. Norpar is a hydrocarbon solution, which is the mixture of $C_{10}H_{22}$, $C_{11}H_{24}$, $C_{12}H_{26}$, $C_{13}H_{28}$. As the developer is attached to the photosensitive drums 121, 122, 123, 124, a latent image is visualized. The visualized image is then transported by the first transfer rollers 171, 172, 173, 174 to the transfer belt 160, and transported by the second transfer roller 180 onto a suitable recording medium. The recording medium is transported to the fuser 190. The ink of the developer has settled onto the recording medium when the recording medium passes through the fuser 190. The liquid carrier is evaporated by the high heat into an inflammable hydrocarbon gas such as methane $CH_4$ and is exhausted.

The hydrocarbon gas, which is classified into volatile organic compound (VOC) group, usually pollutes ambient air, and generates a bad small when discharged without suitable treatment. In order to avoid such problems, various methods have been suggested to remove the hydrocarbon gas.

Among a variety of suggested methods, currently available methods mainly comprise filtering, which physically removes the gaseous component by use of carbon filter such as activated carbon, direct combustion, which bums the gaseous component at temperature ranging from 600° C. to 800° C., and or oxidation, which decomposes the gaseous component into water and carbon dioxide at a relatively low temperature ranging from 150° C. to 400° C. by use of suitable catalyst.

Filtering using the carbon filter is incapable of decomposing the carrier, and therefore needs be replaced at regular intervals when the amount of collected carrier exceeds a predetermined extent. The direct combustion method has safety issues due to use of high temperature heat.

With the above considered, oxidation catalyzing is deemed to be the most effective method and most popularly used due to its high decomposition efficiency and safety.

SUMMARY OF THE INVENTION

The present invention has been developed in order to solve the above drawbacks and other problems associated with the conventional arrangement. An aspect of the present invention is to provide a wet type electrophotographic image forming apparatus with an improved oxidation catalyst device providing better oxidation decomposition efficiency and greater safety, and a method for controlling the oxidation catalyst device thereof.

A wet type electrophotographic image forming apparatus comprises a photosensitive medium, a light exposure device, a developing device, a transfer device, a fuser device, an oxidation catalyst device, a temperature sensor, a power supply device and a control device. The oxidation catalyst device comprises an oxidation catalyst carrying body and a heater, and removes developer solution vapors from the fuser device by utilizing oxidation decomposition. The control device receives data about the temperature detected from the temperature sensor, and variably controls the temperature of the oxidation catalyst device in accordance operational modes such as warm-up mode, standby mode and print mode. Considering the fact that the oxidation catalyst device has higher efficiency at optimum activation temperature, appropriate temperature control can guarantee increased oxidation efficiency of the oxidation catalyst device.

A switching circuit may also be installed between the power supply device and the heater. The control device can variably control the temperature of the oxidation catalyst device by controlling when the switching circuit is on and off.

In one aspect of the present invention, an additional protective circuit may be provided to automatically cut off power from the power supply device to the heater.

According to one embodiment of the present invention, a control method of a wet type electrophotograhpic image forming apparatus controls the temperature of an oxidation catalyst device, which comprises an oxidation catalyst carrying body and a heater. More specifically, the control method variably controls the temperature of the oxidation catalyst device in accordance with operational modes of the image forming apparatus such as warm-up mode, standby mode and print mode. In the warm-up mode, the heater is switched on to raise the temperature H of the oxidation catalyst device to an activation temperature $H_A$. In the standby mode, the temperature H of the oxidation catalyst device is maintained at a standby temperature $H_R$. In the print mode, the temperature H of the oxidation catalyst device is maintained at an activation temperature $H_A$.

The activation temperature $H_A$ may range from about 190° C. to about 230° C., and the standby temperature $H_R$ may range from about 100° C. to about 150° C.

According to one aspect of the present invention, a heating-error recognizing step may be further provided in which a heating error of the oxidation catalyst device is recognized and the heater is switched off if the temperature H of the oxidation catalyst device is lower than a minimum activation temperature $H_a$ after a predetermined heating time $T_1$ from the time the heater is on.

The minimum activation temperature $H_a$ may be approximately 190° C. According to yet another aspect of the present invention, an open-error recognizing step may be further provided. In the open-error recognizing step, an open-error of the oxidation catalyst device is recognized and the heater is switched off if the temperature H of the oxidation catalyst device is equal to or lower than a minimum abnormal temperature $H_m$ after a predetermined heating time $T_1$ from the time the heater is on. The minimum abnormal temperature $H_m$ may be approximately 30° C.

In the print mode, if the recording medium is moved out of the fuser device, the temperature H of the oxidation catalyst device is maintained at the activation temperature $H_A$ to remove vapor of the residual developer solution from the fuser device, and then the temperature H is changed to the standby temperature $H_R$.

According to yet another aspect of the present invention, if an error occurs during printing, it is determined whether there is any developer solution vapor at the fuser device or oxidation catalyst device. If so, the temperature H of the oxidation catalyst device is maintained at the activation temperature $H_A$. After a residual vapor removal time $T_W$, which is approximately until after the vapor of the developer solution is decomposed by oxidation, the heater is switched off.

According to yet another aspect of the present invention, a heater-off step may further be provided if the temperature H of the oxidation catalyst device is equal to or greater than a maximum temperature $H_M$. The maximum temperature $H_M$ may be approximately 230° C.

According to still another aspect of the present invention, the control method of the oxidation catalyst device may further comprise a power-save mode in which the heater is switched off.

BRIEF DESCRIPTION OF THE DRAWINGS

The above objects and other advantages of the present invention will be more apparent from the following detailed description taken in conjunction with the accompanying drawings, in which.

DETAILED DESCRIPTION OF THE PREFERRED EMBODIMENTS

Figure 1:
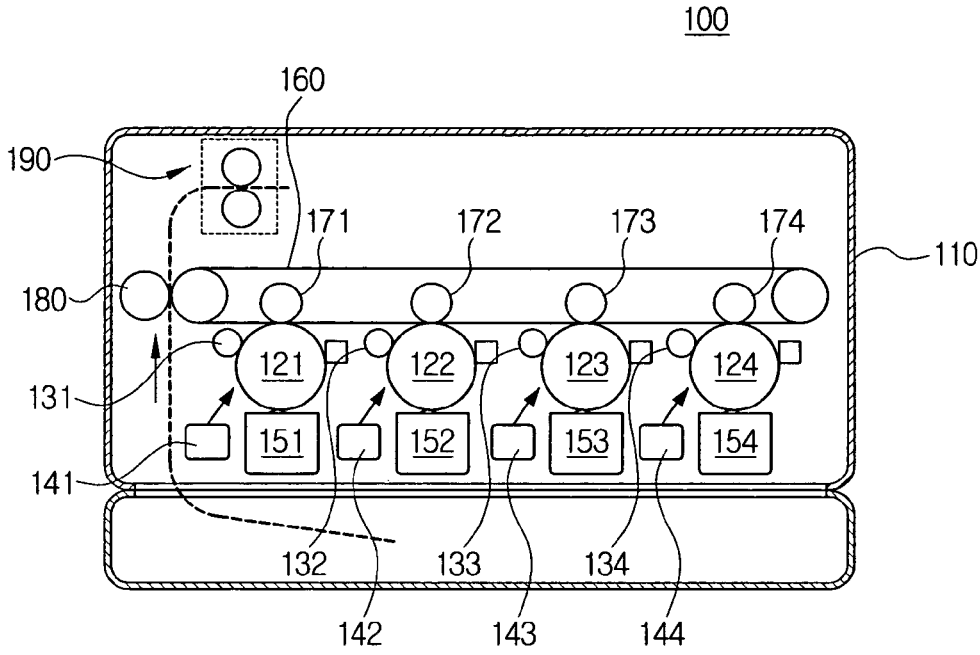
FIG. 1 (PRIOR ART)
FIG. 1 is a view schematically illustrating the structure of a conventional wet type electrophotographic image forming apparatus.

Certain embodiments of the present invention will now be described in greater detail with reference to the accompanying drawings.

In the following description, the same drawing reference numerals are used for the same elements even in different drawings. The matters defined in the description such as a detailed construction and elements are provided to assist in a comprehensive understanding of the invention. Also, well-known functions or constructions are not described in detail since they would obscure the invention in unnecessary detail.

Figure 2:
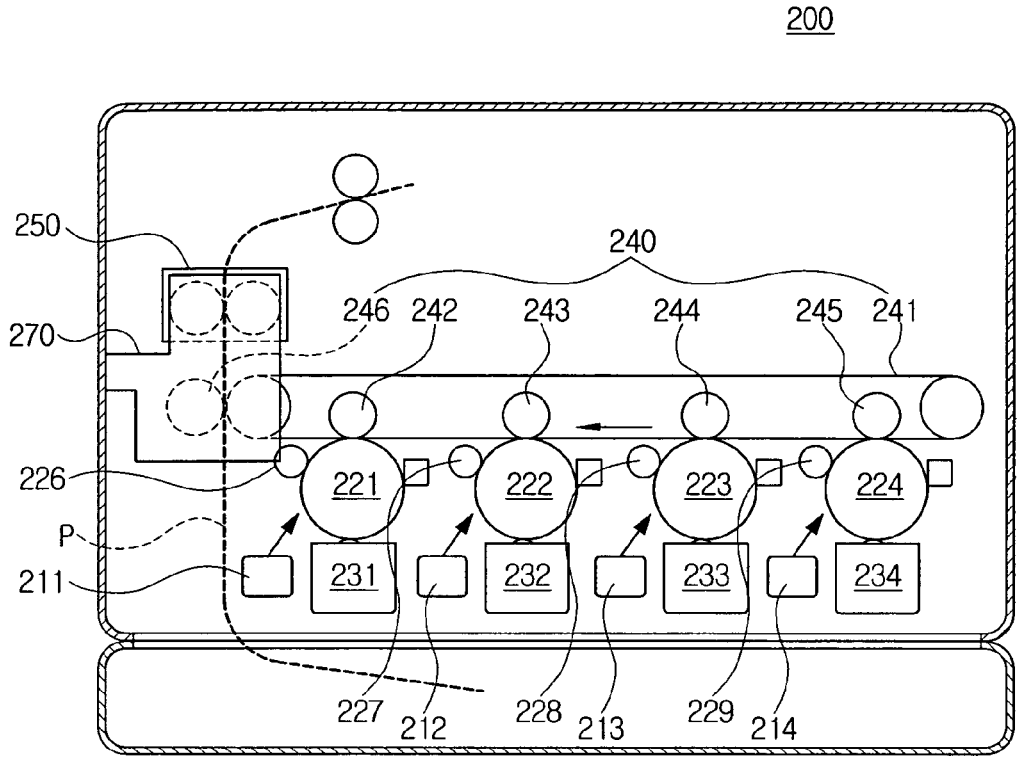
FIG. 2 is a view schematically illustrating the structure of a wet type electrohotographic image forming apparatus according to an embodiment of the present invention.
Figure 3:
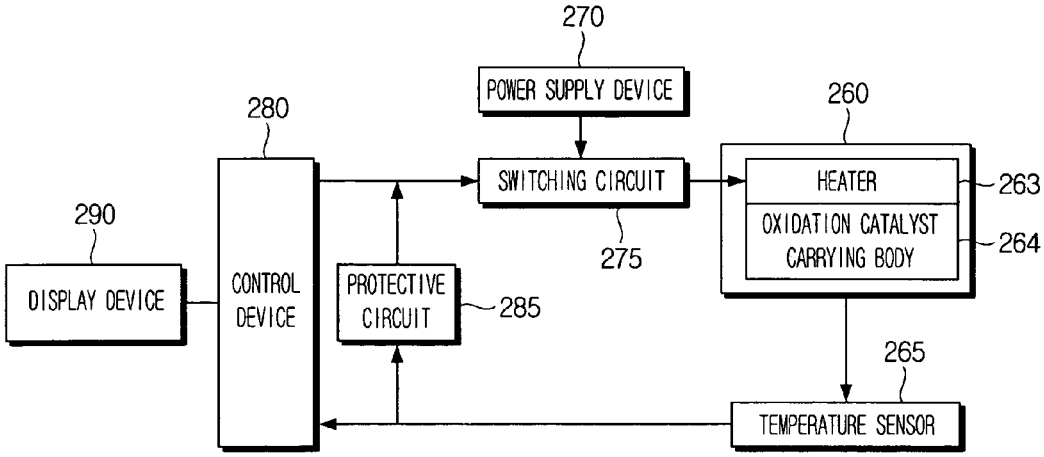
FIG. 3 is a block diagram of a main part of a wet type electrophotograhic image forming apparatus according to an embodiment of the present invention.

Referring to FIGS. 2 and 3, a wet type electrophotographic image forming apparatus 200 according to one embodiment of the present invention comprises light exposure devices 211, 212, 213, 214, photosensitive drums 221, 222, 223, 224, charging devices 226, 227, 228, 229, developing devices 231, 232, 233, 234, a transfer device 240, a fuser 250, an oxidation catalyst device 260, a power supply device 270 and a control device 280.

The light exposure devices 211, 212, 213, 214 each generates laser beams, and emits the generated laser beams onto the photosensitive drums 221, 222, 223, 224 which are charged by the charging devices 226, 227, 228, 229 at a predetermined voltage. Being coated with photo-conductive layers, the photosensitive drums 221, 222, 223, 224 each has a potential difference on the surface, which renders an electrostatic latent image thereon.

The developer devices 231, 232, 233, 234 each supplies developer solution to the photosensitive drums 221, 222, 223, 224. More specifically, the developer devices 231, 232, 233, 234 each stores therein different colors of developer solutions such as yellow, magenta, cyan and black, to feed them to corresponding locations on the photosensitive drum surface bearing the electrostatic latent image. When the developer solution attaches to the surface of the photosensitive drums 221, 222, 223, 224, the electrostatic latent image is visualized. Meanwhile, the developer solution comprises ink for developing an electrostatic latent image, and carrier in a liquid state to help the ink to move. The carrier may be a hydrocarbon gas such as Norpar or any other suitable carrier.

The transfer device 240 transports the visualized image from the photosensitive drums 221, 222, 223, 224 to a recording medium. The transfer device 240 comprises a transfer belt 241, first transfer rollers 242, 243, 244, 245 and a second transfer roller 246. As shown in FIG. 2, the transfer belt 241 receives a visualized image while running in contact with the surface of the photosensitive drums 221, 222, 223, 224. The first transfer rollers 242, 243, 244, 245 are disposed in register with the photosensitive drums 221, 222, 223, 224, and operate to transport the visualized image of the photosensitive drums 221, 222, 223, 224 onto the transfer belt 241. As a result, a color image preferably bearing four colors yellow, magenta, cyan and black, is formed on the transfer belt 241. The second transfer roller 246 transports the color image from the transfer belt 241 onto the recording medium.

Figure 4:
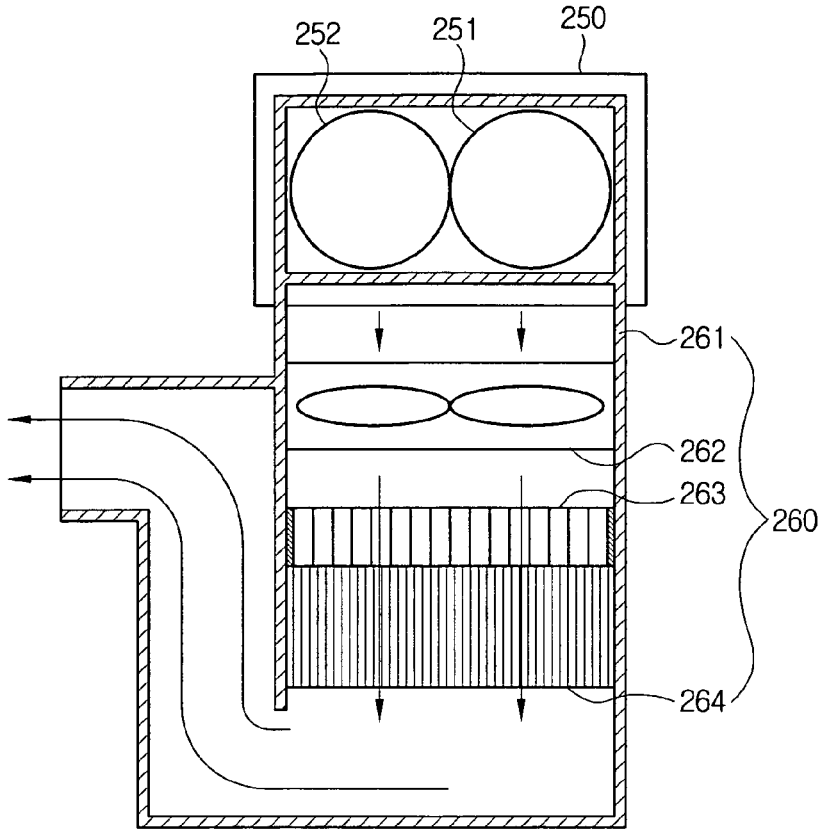
FIG. 4 is a sectional view schematically illustrating an oxidation catalyst device of a wet type electrophotographic image forming apparatus according to an embodiment of the present invention.

The fuser 250 fixes the color image onto the recording medium by using heat and pressure. During the fusing process, the liquid carrier evaporates generating a developer gas in the air. As shown in FIG. 4, the fuser 250 comprises a heating roller 251 and a pressure roller 252 in tight contact with the heat roller 251. The recording medium passes through the heating roller 251 and the pressure roller 252.

Figure 5:
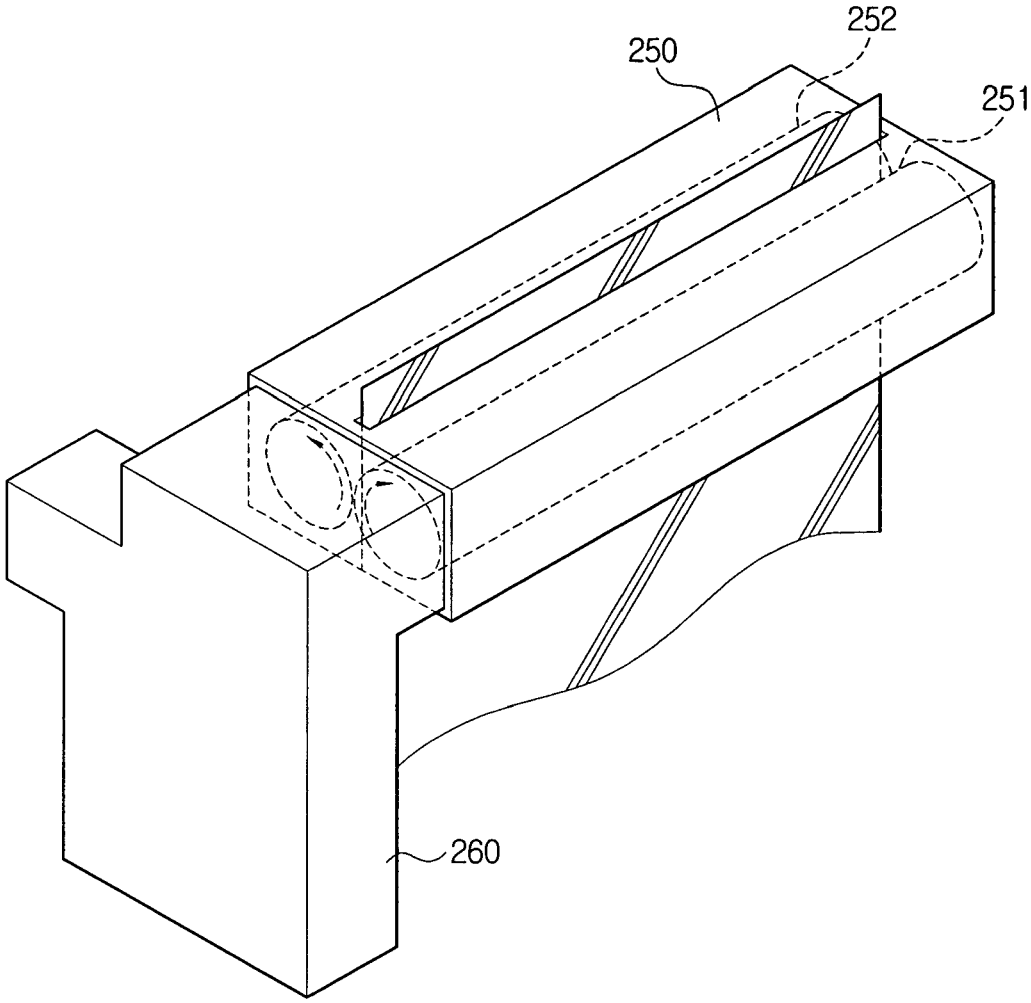
FIG. 5 is a perspective view illustrating an oxidation catalyst device of a wet type electrophotographic image forming apparatus according to an embodiment of the present invention.

The oxidation catalyst device 260 removes developer gas, which is generated at the fuser 250. As shown in FIG. 5, the oxidation catalyst device 260 is preferably connected to the fuser 250. Referring to FIG. 4, the oxidation catalyst device 260 comprises a duct 261, a fan 262, a heater 263 and an oxidation catalyst carrying body 264. One end of the duct 261 is connected to a side of the fuser 250 so that the developer gas is guided outside the image forming apparatus 200. The fan 262 is mounted in the duct 261 to forcibly blow the developer gas at the fuser 250 toward the oxidation catalyst carrying body 264. The heater 263 increases the temperature of the developer gas to an activation temperature, for example, of approximately 200° C. The oxidation catalyst carrying body 264 carries a catalyst, such as platinum Pt and palladium Pd, to increase the rate of oxidation decomposition of the developer gas. The oxidation catalyst carrying body 264 is preferably mounted behind the heater 263. A temperature sensor 265 (FIG. 3) is preferably mounted at a side of the oxidation catalyst device 260 to detect the temperature of the oxidation catalyst device 260.

Referring to FIG. 3, the power supply device 270 supplies power to the heater 263 of the oxidation catalyst device 260 causing high temperature heat at the heater 263. A switching circuit 275 is installed between the power supply device 270 and the heater 263 to control power supplied from the power supply device 270 to the heater 263.

As shown in FIG. 3, the control device 280 controls the temperature of the heater 263 so that the temperature of the oxidation catalyst device 260 can vary in accordance with various modes, such as warm-up mode, standby mode, print mode and power-save mode. More specifically, the control device 280 controls the power supplied to the heater 263 by controlling the on/off operation of the switching circuit 275 based on the information about the temperature of oxidation catalyst device 260, which is output from the temperature sensor 265. Additionally, the control device 280 detects various errors generated during the printing through various corresponding sensors (not shown) installed in the image forming apparatus 200. The control device 280 also indicates the detected results through a display device 290.

Figure 6A:
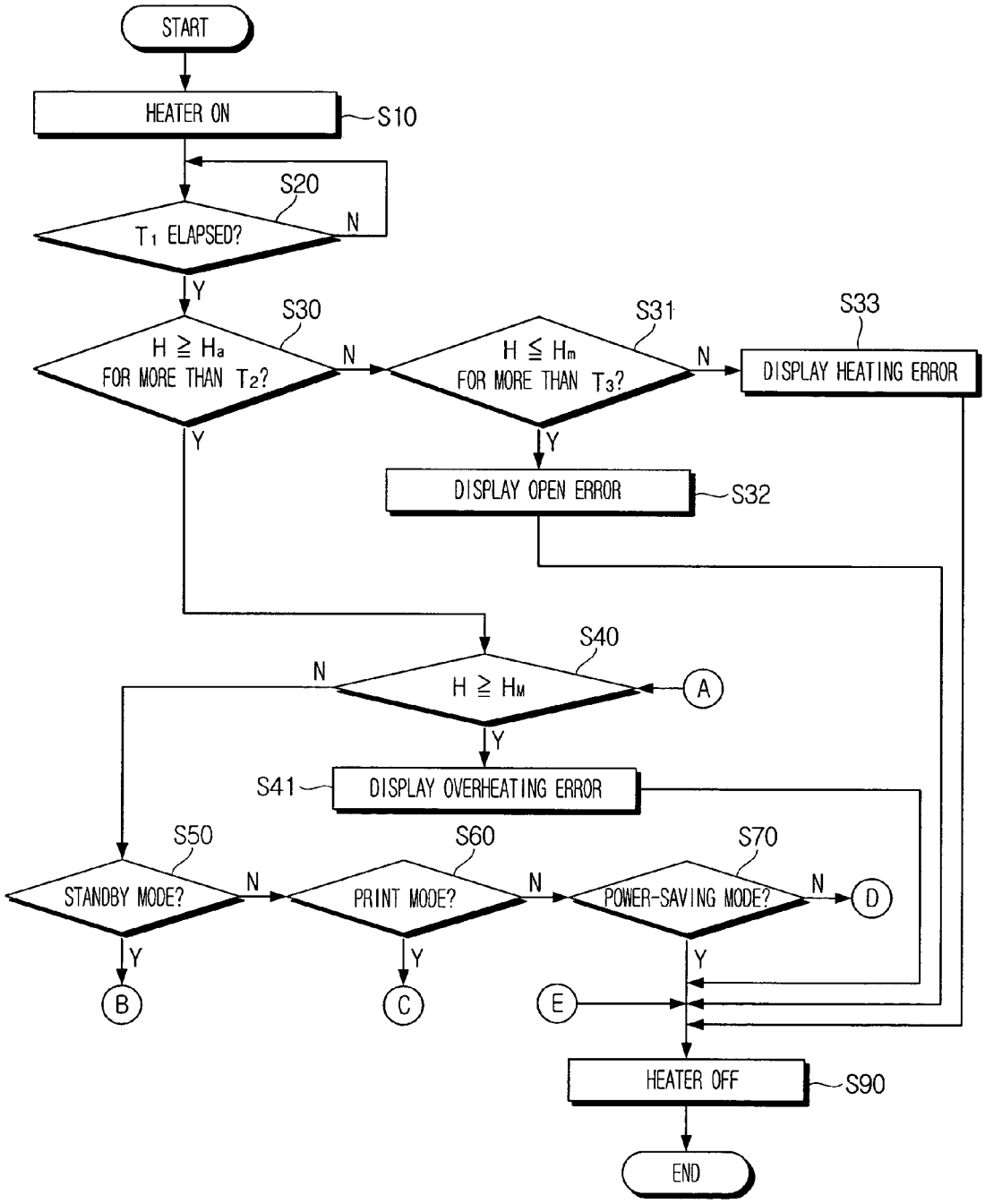
FIGS. 6A to 6D are flowcharts illustrating control processes of an oxidation catalyst device according to an embodiment of the present invention.
Figure 6B:
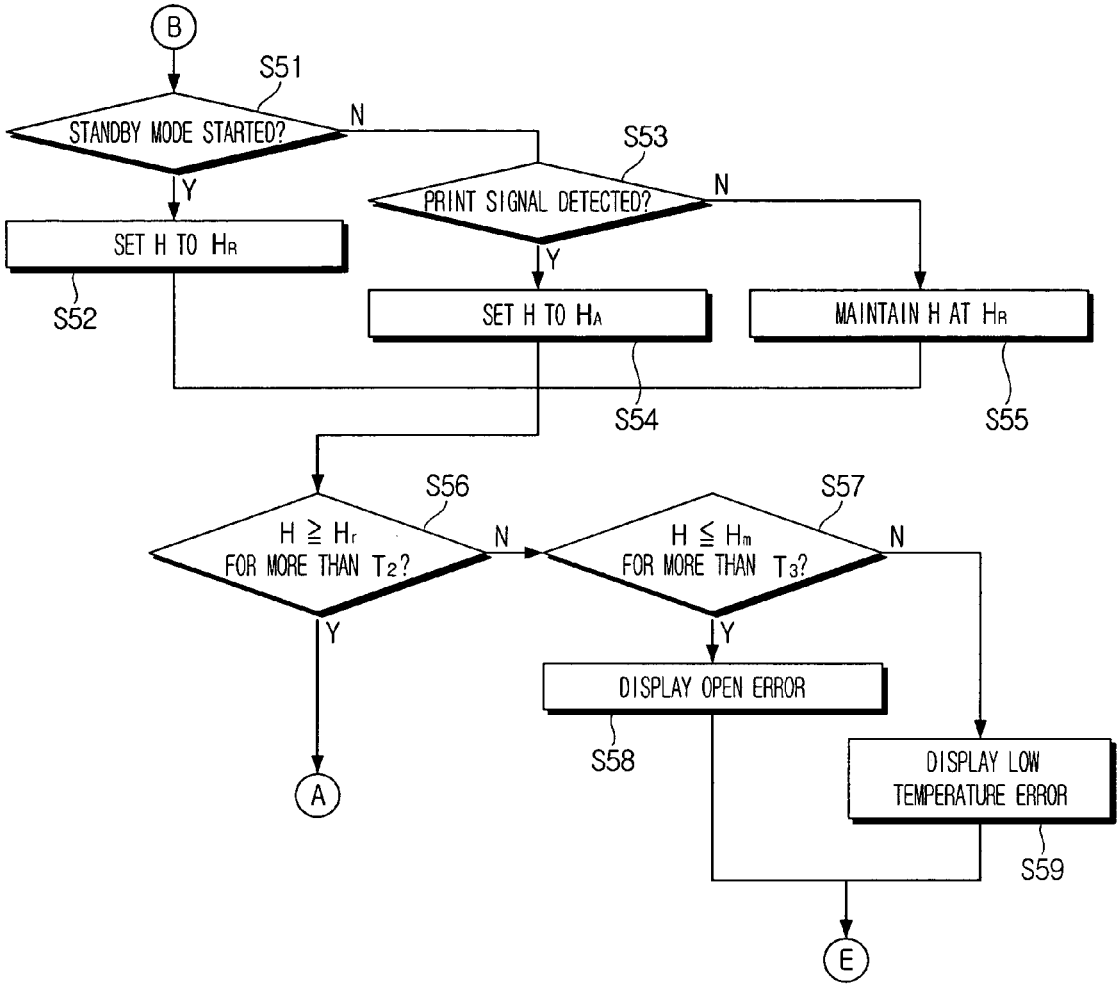
Figure 6C:
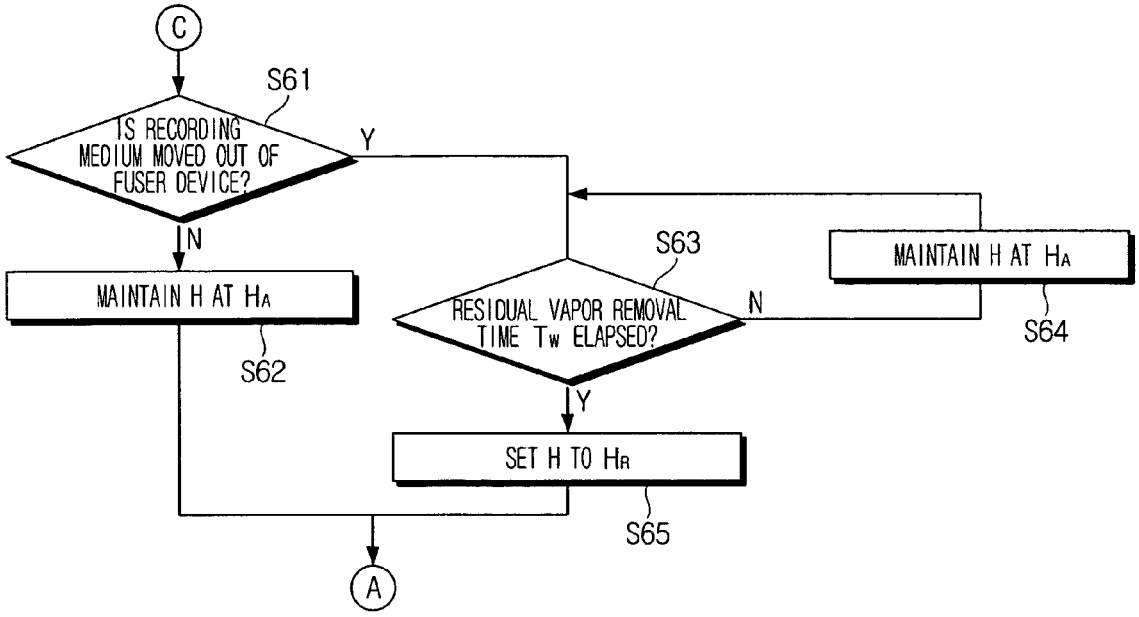
Figure 6D:
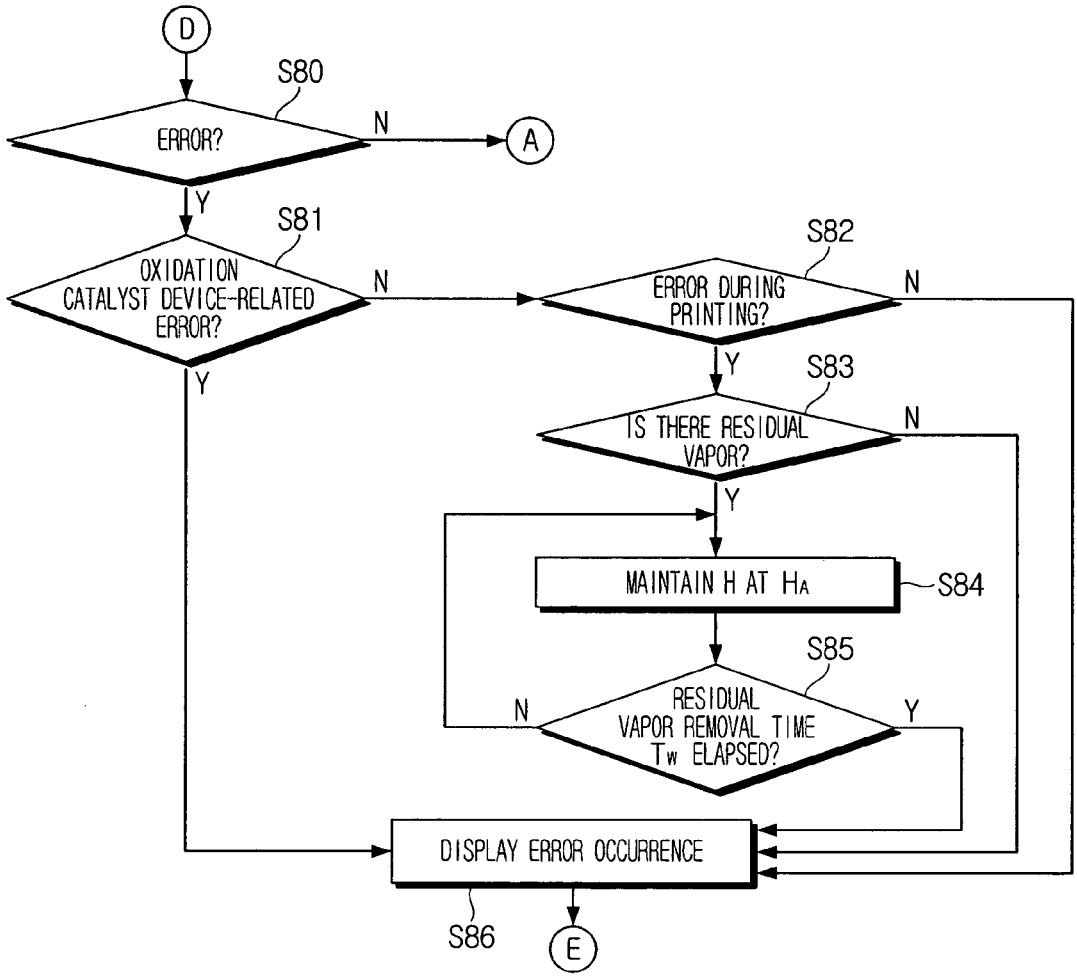
Figure 7:
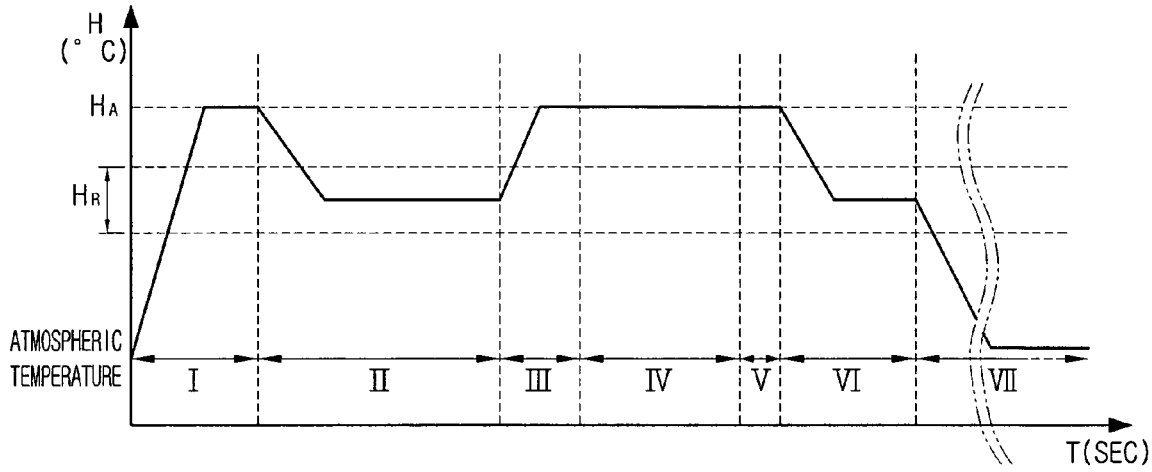
FIG. 7 is a graphical representation of a temperature change of an oxidation catalyst device of a wet type electrophotographic image forming apparatus according to an embodiment of the present invention.

Referring now to FIGS. 6A to 7, the operation of the wet type electrophotographic image forming apparatus 200 and a method for controlling an oxidation catalyst device thereof according to an embodiment of the present invention will now be described in greater detail.

When the image forming apparatus 200 (FIG. 2) is powered on, the image forming apparatus 200 starts in the warm-up mode. Accordingly, the heater 263 (FIG. 3) is turned on (step S10), and the temperature H of the oxidation catalyst device 260 rises from the atmospheric temperature to a predetermined activation temperature $H_A$. At the activation temperature $H_A$, the reaction of the developer gas, which is generated as the hydrocarbon carrier evaporates, to the oxidation catalyst increases. The activation temperature $H_A$ generally ranges from about 190° C. to about 230° C., although 200° C. is more preferable.

In warm-up mode, the control device 280 (FIG. 3) checks to see whether the oxidation catalyst device 260 (FIG. 3) is operating in a normal condition or not. Considering a certain amount of time required for the heater 263 to reach the activation temperature $H_A$ after the power-on, as shown in FIG. 6A, the control device 280 determines whether a predetermined heating time $T_1$ has passed after the power-on of the heater 263 (step S20). If so, the control device 280 determines based on the data output from the temperature sensor 265 (FIG. 3) whether the temperature H of the oxidation catalyst device 260 has reached a minimum activation temperature $H_a$. Additionally, considering the fact that the heater temperature can abruptly rise or drop, the control device 280 checks to confirm whether the temperature of the oxidation catalyst device 260 (FIG. 3) stays within the minimum activation temperature $H_a$ for a first check time $T_2$ (step S30). The minimum activation temperature $H_a$ is approximately 190° C., the heating time $T_1$ and the first check time $T_2$ are, based on experiments, approximately 15 seconds and approximately 5 seconds, respectively.

If the oxidation catalyst device 260 does not reach the minimum activation temperature $H_a$, the control device 280 checks to confirm whether the temperature of the oxidation catalyst device 260 stays below a minimum abnormal temperature $H_m$ for a second check time $T_3$ (step S31). The minimum abnormal temperature $H_m$ is approximately 30° C., and the second check time $T_3$ is approximately 2 seconds. If the temperature of the oxidation catalyst device 260 is below the minimum abnormal temperature $H_m$, the control device 280 determines the oxidation catalyst device 260 to be open, and therefore, turns off the heater 263 (FIG. 3), and indicates open-error of the oxidation catalyst device 260 through the display device 290 (FIG. 3) (step S32). If the temperature H of the oxidation catalyst device 260 is lower than the minimum activation temperature $H_a$ and higher than the minimum abnormal temperature $H_m$, the control device 280 determines that the temperature increase of the oxidation catalyst device 260 is problematic. Therefore, the heater 263 is turned off and the heating-error of the oxidation catalyst device 260 is indicated through the display device 290 (step S33).

If the temperature H of the oxidation catalyst device 260 stays above the minimum activation temperature $H_a$ for more than the first check time $T_2$, the control device 280 checks to confirm whether the temperature H of the oxidation catalyst device 260 is above a maximum abnormal temperature $H_M$ (step S40). At maximum abnormal temperature $H_M$, the image forming apparatus 200 is prone to break, and use of the apparatus becomes unsafe. The maximum abnormal temperature $H_M$ is approximately 230° C. or beyond. If the temperature sensor 265 senses the oxidation catalyst device 260 to reach or exceed 230° C., a protective circuit 285 (FIG. 3) automatically switches off the switching circuit 275 (FIG. 3) to block the power supply to the heater 263. The control device 280 indicates overheating-error of the oxidation catalyst device 260 through the display device 290 (step S41). A check of the overheating error is continuously performed during the temperature control.

If the temperature H of the oxidation catalyst device 260 in warm-up mode is equal to or greater than the minimum activation temperature $H_a$ and lower than the maximum abnormal temperature $H_M$, the control device 280 determines whether the operational mode of the image forming apparatus 200 corresponds to standby mode (step S50).

If the image forming apparatus 200 is determined to be in standby mode, as shown in FIG. 6B, the control device 280 determines whether standby mode has started (step S51). If so, the control device 280 drops the temperature H of the oxidation catalyst device 260 to below a predetermined standby temperature $H_R$, as represented by interval II in FIG. 7, to start the standby mode of the image forming apparatus 200. At standby temperature $H_R$, the temperature H of the oxidation catalyst device 260 rapidly rises to the activation temperature $H_A$, and it generally ranges from about 100° C. to about 150° C. After the temperature H of the oxidation catalyst device 260 is set to standby temperature $H_R$ (step S52), the control device 280 receives temperature data from the temperature sensor 265 to determined whether the temperature H is equal to or higher than a minimum standby temperature $H_r$. At this time, considering the fact that the temperature H of the oxidation catalyst device 260 can abruptly rise or drop, the control device 280 checks to see whether the temperature H stays above the minimum standby temperature $H_r$ for the first check time $T_1$ (step S56). The minimum standby temperature $H_r$ is approximately 90° C., and the first standby mode check time $T_1$ is approximately 5 seconds. If the temperature H of the oxidation catalyst device 260 is not maintained above the minimum standby temperature $H_r$ during the first standby mode check time $T_1$, the control device 280 determines whether the temperature H is equal to or below the minimum abnormal temperature $H_m$ (step S57). If so, the control device 280 indicates open-error of the oxidation catalyst device 260 (step S58), and turns off the heater 263 (step S90; FIG. 6A). If the temperature H of the oxidation catalyst device 260 is higher than the minimum abnormal temperature $H_m$ and lower than the minimum standby temperature $H_R$, the control device 280 determines that the oxidation catalyst device 260 in the standby mode is in abnormal state, and therefore indicates low temperature-error through the display device 290 (step S59) and turns off the heater 263 (step S90).

Referring to FIG. 6A, if the standby mode has not been started, the control device 280 (FIG. 3) determines whether a print signal is detected or not (step S53). If so, the control device 280 sets the temperature H of the oxidation catalyst device 260 to the activation temperature $H_A$ (step S54), and increases the temperature H to the activation temperature $H_A$ as represented by the interval III of FIG. 7 (step S54). If the temperature H of the oxidation catalyst device 260 is set to activation temperature $H_A$, the control device 280 detects low temperature-error and open-error of the oxidation catalyst device 260 (steps S56, S57). If there is print signal detected, the control device 280 maintains the temperature of the oxidation catalyst device 260 at the standby temperature $H_R$ (step S55). In this case too, the control device 280 detects low temperature-error and open-error of the oxidation catalyst device 260 (steps S56 and S57). If the temperature H of the oxidation catalyst device 260 stays above the minimum standby temperature $H_r$ for the first print check time $T_2$, overheating of the oxidation catalyst device 260 is checked (step S40; FIG. 6A).

If it is not the standby mode in the rest parts of the control flow of the control device 280, the control device 280 (FIG. 3) determines whether the operation mode of the image forming apparatus 200 (FIG. 2) is print mode or not (step S60). If print mode, the temperature H of the oxidation catalyst device 260 remains approximately within the activation temperature $H_A$, and the respective components of the image forming apparatus 200 are operated for printing purposes.

Referring back to FIG. 2, the light exposure devices 211, 212, 213, 214 scan laser beams onto the surfaces of the photosensitive drums 221, 222, 223, 224, which are charged to a predetermined potential by the charging rollers 226, 227, 228, 229. As a result, electrostatic latent images are formed on the surface of the photosensitive drums 221, 222, 223, 224, and the electrostatic latent images are visualized by the developer solution fed from the developer devices 231, 232, 233, 234. The visualized images on the photosensitive drums 221, 222, 223, 224 are transported onto the transfer belt 241 by the first transfer rollers 242, 243, 244, 245, deposited by respective colors such as yellow, magenta, cyan and black in a predetermined pattern, thereby forming the desired color image. The second transfer roller 246 transports the color image onto the recording medium passing along the recording medium conveyance path P, and the fuser 250 fixes the color image onto the recording medium by using heat and pressure.

Meanwhile, the oxidation catalyst device 260 drives the fan 262 (FIG. 5) to forcibly blow developer gas of the fuser 250 toward the oxidation catalyst carrying body 264 (FIG. 5). The temperature H of the oxidation catalyst device 260 is approximately maintained within the activation temperature $H_A$ as represented by the interval IV of FIG. 7. The developer gas passing through the oxidation catalyst carrying body 264 is decomposed by oxidation into water and carbon dioxide and discharged to the outside via duct 261 (FIG. 5).

During printing, the control device 280 (FIG. 3) determines whether the recording medium has passed through the fuser 250 or not (step S61) (FIG. 6C). Whether the recording medium has passed through the fuser 250 or not can be determined by various available methods, including installing a recording medium sensor (not shown) at the fuser 250 and using a signal transmitted therefrom, or calculating based on the time when the recording medium has entered into the recording medium conveyance path P. As the fusing process is carried out, the control device 280 maintains the temperature H of the oxidation catalyst device 280 within approximately the activation temperature $H_A$ (step S62), and after the recording medium has passed through the fuser 250, the control device 280 determines whether a residual gas removal time $T_W$ has elapsed (step S63). The residual gas removal time $T_W$ is set, depending on the various factors including the amount of developer gas in accordance with the recording medium size, and size of the oxidation catalyst device 260 (FIG. 2). If the residual gas removal time $T_W$ has not passed, the control device 280 maintains the temperature H of the oxidation catalyst device 260 at approximately the activation temperature $H_A$ (step S64). The residual developer gas is removed in the interval V of FIG. 7. If the residual gas removal time $T_W$ has passed, the control device 280, as represented in the interval VI of FIG. 7, drops the temperature H of the oxidation catalyst device 260 to approximately the standby temperature $H_R$ (step S65).

It should be understood that the temperatures recited herein are only exemplary. The temperatures variables may also represent an approximate range of temperature values, not a specific temperature value.

If the operation mode of the image forming apparatus 200 is neither the standby mode nor the print mode in the rest steps of the control flow of the image forming apparatus 200 of FIG. 6A, the control device 280 determines if it is power-save mode (step S70). If a print signal is not applied for a predetermined time, the control device 280 determines it as the power-save mode, and switches off the heater 263 (FIG. 3) (step S90) to prevent unnecessary power consumption. As a result, the temperature H of the oxidation catalyst device 260 drops to the atmospheric temperature, as represented in the interval VII of FIG. 7.

In executing the steps according to the control flow of the control device 280 as described above, the control device 280, as shown in FIG. 6D, determines whether any error has occurred (step S80). If an error has occurred, the control device 280 determines whether the error is associated with the oxidation catalyst device 260 (step S81). If the error is associated with an abnormality such as breakage of the components of the oxidation catalyst device 260, including the duct 261 (FIG. 5), the fan 262 (FIG. 5), the heater 263 (FIG. 5) or the oxidation catalyst carrying body 264 (FIG. 5), the control device 280 indicates the occurrence of an error through the display device 290 (FIG. 3) (step S86), and switches off the heater 263 (step S90; FIG. 6A). If the error has occurred for reasons other than the oxidation catalyst device 260, the control device 280 determines if the error has occurred during printing (step S82). If the error is determined to have occurred irrespective of the printing, the control device 280 indicates occurrence of an error (step S86) and turns off the heater 263 (step S90).

The control device 280 controls the temperature of the oxidation catalyst device 260, mainly, by controlling the power supply to the heater 263. More specifically, the control device 280 switches on/off the switching circuit 275 based on the data received about the temperature of the oxidation catalyst device 260 from the temperature sensor 265 installed at the oxidation catalyst device 260. This is especially important when the oxidation decomposition of developer gas during the print mode causes heat of reaction to reach approximately 150° C. Accordingly, the control device 280 cuts off power supplied to the heater 263 during most of the time of the print mode so as to prevent overheating of the oxidation catalyst device 260.

As described above in a few exemplary embodiments of the present invention, the temperature of the oxidation catalyst device 260 is checked through temperature sensor 265 and adjusted according to each mode of the operation, such as warm-up mode, standby mode, print mode and power-save mode. As a result, oxidation decomposition efficiency of the oxidation catalyst device 260 increases, while overheating and subsequent breakage of the oxidation catalyst device 260 can be prevented. Additionally, because the power supply to the oxidation catalyst device 260 can be controlled appropriately, a power-saving effect is also realized.

Although preferred embodiments have been described for illustrative purposes, the present invention is not to be unduly limited to the configuration or operation set forth herein. Those skilled in the art will appreciate that various modifications, additions and substitutions are possible, without departing from the scope and spirit of the invention as disclosed in the accompanying claims.

What is claimed is:

1. A wet type electrophotographic image forming apparatus, comprising:

a photosensitive medium;

a light exposure device for scanning a laser bean onto the photosensitive medium;

a developing device for attaching a developer solution onto the photosensitive medium;

a transfer device for transporting the developer solution from the photosensitive medium onto a recording medium;

a fuser device for applying heat to the recording medium where the developer solution is transported;

an oxidation catalyst device comprising an oxidation catalyst carrying body to accelerate oxidation decomposition of a vapor from the developer solution, and a heater to applying heat to the oxidation catalyst carrying body;

a temperature sensor for sensing a temperature of the oxidation catalyst device;

a power supply device for supplying power to the heater; and a control device for receiving a data about the detected temperature from the temperature sensor, and variably controlling the temperature of the oxidation catalyst device in accordance with operation modes comprising warm-up mode, standby mode and print mode.

2. The wet type electrophotographic image forming apparatus of claim 1, wherein a switching circuit is installed between the power supply device and the heater, and the control device variably controls the temperature of the oxidation catalyst device by controlling the on/off switching of the switching circuit.

3. The wet type electrophotographic image forming apparatus of claim 1, further comprising a protective circuit, which automatically cuts off power supplied from the power supply device to the heater when the temperature of the oxidation catalyst device exceeds a maximum abnormal temperature $H_M$.

4. A method for controlling an oxidation catalyst device of a wet type electrophotographic image forming apparatus, the oxidation catalyst device comprising an oxidation catalyst carrying body to accelerate oxidation decomposition of a vapor of a developer solution which is generated at a fuser device of the wet type electrophotographic image forming apparatus, and a heater to heat the oxidation catalyst carrying body, the control method comprising the steps of:

operating in a warm-up mode in which the temperature H of the oxidation catalyst device is raised to an activation temperature $H_A$;

operating in a standby mode in which the temperature H of the oxidation catalyst device is maintained within a standby temperature $H_R$; and operating in a print mode in which the temperature H of the oxidation catalyst device is maintained within the activation temperature $H_A$.

5. The control method of claim 4, wherein the temperature control of the heater is carried out by on/off-controlling the power supply to the heater.

6. The control method of claim 4, wherein the activation temperature $H_A$ has the range satisfying, $$190° \text{ C.} \leqq H_A < 230° \text{ C.}$$

7. The control method of claim 4, wherein the standby temperature $H_R$ has the range satisfying, $$100° \text{ C.} \leqq H_R < 150° \text{ C.}$$

8. The control method of claim 4, further comprising a step of switching off the heater when the temperature of the oxidation catalyst device is below a minimum activation temperature $H_a$ after a predetermined heating time $T_1$ from the heater-on.

9. The control method of claim 8, wherein the minimum activation temperature $H_a$ is approximately 190° C.

10. The control method of claim 4, further comprising the step of switching off the heater when the temperature of the oxidation catalyst device is below a minimum abnormal temperature $H_m$ after a predetermined heating time $T_1$ from the heater-on.

11. The control method of claim 10, wherein the minimum abnormal temperature $H_m$ is approximately 30° C.

12. The control method of claim 4, further comprising the step of raising the temperature H of the oxidation catalyst device to the activation temperature $H_A$ when a print signal is detected during the standby mode.

13. The control method of claim 4, further comprising the step of switching off the heater when the temperature H of the oxidation catalyst device is lower than a minimum standby temperature $H_r$ during the standby mode.

14. The control method of claim 13, wherein the minimum standby temperature $H_r$ is approximately 90° C.

15. The control method of claim 4, further comprising the steps of:

determining whether the recording medium is moved out of the fuser device during the print mode;

if the recording medium is moved out of the fuser device, determining whether a residual vapor removal time $T_W$, during which the vapor of the developer solution remaining in the fuser device is decomposed by oxidation, has elapsed;

if the residual vapor removal time $T_W$ has elapsed, changing the temperature H of the oxidation catalyst device to the standby temperature $H_R$; and if the residual vapor removal time $T_W$ has not elapsed, maintaining the temperature H of the oxidation catalyst device at the activation temperature $H_A$.

16. The control method of claim 4, further comprising the steps of:

determining whether any error has occurred;

determining whether the error has occurred during printing;

if the error has occurred during printing, determining whether there is any vapor from a residual developer solution;

if there is vapor from residual developer solution, maintaining the temperature H of the oxidation catalyst device at the activation temperature $H_A$;

determining whether a residual vapor removal time $T_W$, during which the vapor from the residual developer solution is decomposed by oxidation, has elapsed; and if residual vapor removal time $T_W$ has elapsed, switching off the heater.

17. The control method of claim 4, further comprising the steps of:

determining whether the temperature H of the oxidation catalyst device is equal to or greater than a maximum abnormal temperature $H_M$; and if the temperature H of the oxidation catalyst device equal to or greater than a maximum abnormal temperature $H_M$, switching off the heater.

18. The control method of claim 17, wherein the maximum abnormal temperature $H_M$ is approximately 230° C.

19. The control method of claim 4, further comprising the step of operating in a power-save mode in which the heater is switched off.

* * * * *